US006286878B1

(12) United States Patent
Hochart et al.

(10) Patent No.: US 6,286,878 B1
(45) **Date of Patent: *Sep. 11, 2001**

(54) ELECTRICALLY LOCKED MOTOR VEHICLE DOOR LOCK

(75) Inventors: Jean-Philippe Hochart, Buigny-l'Abbe; Joël Girard, Abbeville, both of (FR)

(73) Assignee: Valeo Securite Habitacle, Creteil (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/127,765

(22) Filed: Jul. 31, 1998

(30) Foreign Application Priority Data

| | | |
|---|---|---|
| Jul. 31, 1997 | (FR) | 97 09780 |
| Oct. 8, 1997 | (FR) | 97 12539 |
| May 4, 1998 | (FR) | 98 05604 |

(51) Int. Cl.[7] ..... E05C 3/06; E05C 3/16

(52) U.S. Cl. ..... 292/216; 292/DIG. 25; 70/257

(58) Field of Search ..... 292/216, DIG. 23, 292/201, 336.3, DIG. 25, DIG. 26; 70/257

(56) References Cited

U.S. PATENT DOCUMENTS

| | | | | |
|---|---|---|---|---|
| 3,695,662 | * | 10/1972 | Ploughman | 292/216 |
| 4,667,991 | * | 5/1987 | Pebre | 292/201 |
| 4,897,644 | * | 1/1990 | Hirano | 340/825.31 |
| 5,427,421 | * | 6/1995 | Hamaguchi | 292/216 |
| 5,474,338 | * | 12/1995 | Buscher | 292/201 |
| 5,474,339 | | 12/1995 | Johnson | 292/216 |
| 5,497,641 | * | 3/1996 | Linde et al. | 70/257 |
| 5,613,716 | * | 3/1997 | Cafferty | 292/216 |
| 5,653,484 | * | 8/1997 | Brackmann et al. | 292/216 |
| 5,681,068 | * | 10/1997 | Kleefeldt et al. | 292/336.3 |
| 5,697,236 | * | 12/1997 | Kleefeldt et al. | 70/257 |
| 6,079,237 | * | 6/2000 | Hochart | 70/278.6 |
| 6,102,453 | * | 8/2000 | Cetnar | 292/201 |

FOREIGN PATENT DOCUMENTS

| | | |
|---|---|---|
| 0 645 511 A1 | 3/1995 | (EP) . |
| 2 635 138 A1 | 2/1990 | (FR) . |
| 2 674 895 A1 | 10/1992 | (FR) . |

* cited by examiner

*Primary Examiner*—Lynne H. Browne
*Assistant Examiner*—John B. Walsh
(74) *Attorney, Agent, or Firm*—Connolly Bove Lodge & Hutz

(57) ABSTRACT

The present invention relates to a motor vehicle door lock comprising: a forked latch (2) intended to interact with a striker; a pawl (4) which normally locks the latch in the closed position and which can adopt an "escapement" position in which it no longer acts on the said latch (2); a latch-release mechanism comprising an operating member (9) which, on the one hand, can adopt either an active position in which it acts, during its actuating movement, on the pawl (4) to place it in the "escapement" position, or an inhibited position in which, during its actuating movement, it has no effect on the pawl (4) and, on the other hand, may experience an actuating movement in response to actuation of the door handle by the user; and an electric device which responds at least to an unlock signal by moving the operating member (9) from its inhibited position until it reaches its active position, characterized in that the lock further comprises a camming mechanism (15) which, when the unlock signal is transmitted more or less at the end of the actuating travel of the operating member (9,109), brings the pawl (4) into its "escapement" position.

20 Claims, 5 Drawing Sheets

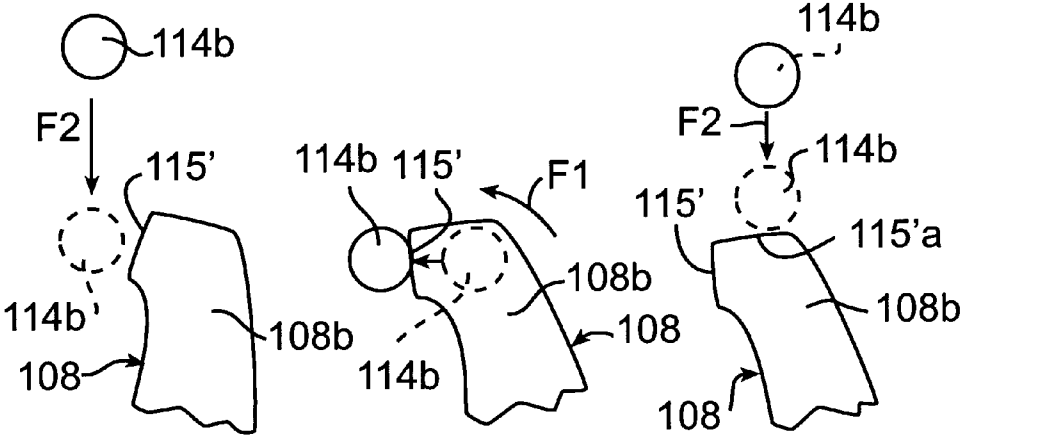
FIG. 9A PRIOR ART
FIG. 9B PRIOR ART
FIG. 9C PRIOR ART
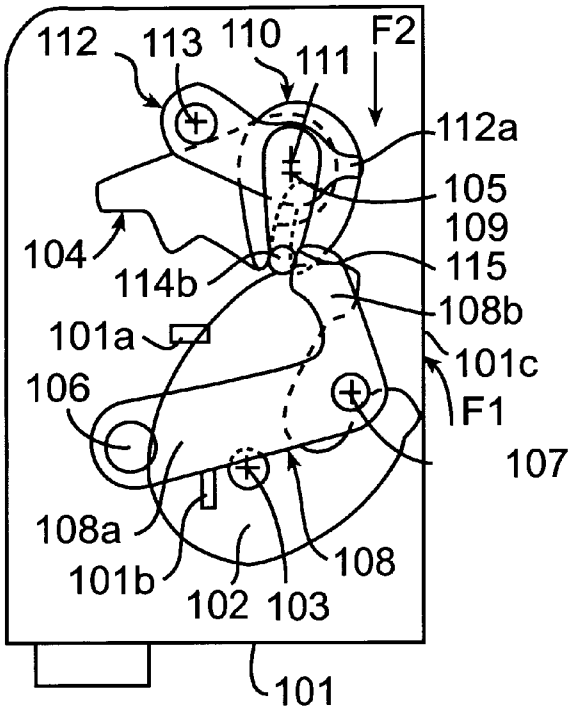
FIG. 8

ELECTRICALLY LOCKED MOTOR VEHICLE DOOR LOCK

The present invention relates to motor vehicle door locks and more particularly to electric locks.

Such locks comprise, as is known, a forked latch intended to interact with a striker, a pawl which normally locks the latch in the closed position, a latch-release mechanism comprising an operating member which experiences an actuating movement in response to actuation of the door handle by the user. The operating member can adopt an active position in which it acts, during its actuating movement, on the pawl in order to place it in the escapement position, and an inhibited position in which, during its actuating movement, it has no effect on the pawl. The lock further comprises an electric device which responds at least to an unlock signal by moving the operating member until it reaches its active position.

Vehicle door lock systems in which the unlock signal is generated by actuation of a lock cylinder are known. In other known systems, this unlock signal is provided by recognition electronics in response to an infrared remote-control or radioelectric remote-control signal produced by the user using an appropriate remote control.

These known systems are not entirely satisfactory because they require the use either of a key or of a remote control, these objects taking up one of the user's hands.

This is why so-called "hands-free access" systems which do not require the use of a key or of a remote control in order to unlock the lock have been proposed. These systems are equipped with recognition electronics fitted with a radio transmitter and designed to be able to dialogue with a radioelectric device incorporated into a wristwatch, a credit card, a badge or the like worn or carried by the user. The recognition electronics do not produce their unlock signal until the correct owner has been identified.

In such systems, the transmission of the unlock signal that operates the electric device, on the one hand, and the actuation of the release mechanism, on the other hand, take place simultaneously.

However, the difference between the relatively long response time of the electric device and the very short response time of the release mechanism is such that the operating member has completed its actuating movement even though it is not yet in the active position, which means that the user's first action on the door handle does not cause the door to open and that the said user has to operate the door handle again in order to open it.

This need to operate the door handle twice is a drawback that the present invention sets out to eliminate.

SUMMARY OF THE INVENTION

The subject of the present invention is therefore a motor vehicle door lock comprising: a forked latch intended to interact with a striker; a pawl which normally locks the latch in the closed position and which can adopt an "escapement" position in which it no longer acts on the said latch; a latch-release mechanism comprising an operating member which, on the one hand, can adopt either an active position in which it acts, during its actuating movement, on the pawl to place it in the "escapement" position, or an inhibited position in which, during its actuating movement, it has no effect on the pawl and, on the other hand, may experience an actuating movement in response to actuation of the door handle by the user; and an electric device which responds at least to an unlock signal by moving the operating member from its inhibited position until it reaches its active position, characterized in that the lock further comprises an opening catch-up means which, when the unlock signal is transmitted more or less at the end of the actuating travel of the operating member, brings the pawl into its "escapement" position.

In a first alternative form, in which the operating member is secured to a lever for opening the lock from the outside, the actuating movement of the operating member in response to actuation of the door handle by the user occurs both when the said operating member is in its active position and when it is in its inhibited position. In a second alternative form, in which the operating member is secured to a lever for locking/unlocking the lock, the actuating movement of the operating member in response to actuation of the door handle by the user occurs only when the operating member (109) is in its active position.

In the first alternative form, advantageously, in a way known per se, the pawl has a peg and the operating member is equipped with a thrust surface and with a recess which are designed such that, when the operating member is in the active position, the thrust surface comes up against and pushes along the said peg during the actuating movement of the operating member until the said pawl has been placed in the "escapement" position, and such that, when the operating member is in the inhibited position, the peg of the pawl, throughout the actuating movement of the said operating member, remains engaged in the said recess so that the operating member has no effect on the pawl.

In a preferred embodiment of the invention, the opening catch-up means is produced as follows: part of the wall delimiting the recess of the operating member, and the adjacent part of the peripheral surface of the peg of the pawl are shaped and positioned in such a way that they respectively form a cam and a cam follower which interact with one another when the operating member is more or less in the end of actuating movement position, the movement of the said operating member by the electric device until it reaches its active position driving, thanks to the cam action of the part of the wall, the peg of the pawl until the said pawl has been placed in the "escapement" position. Advantageously, the thrust surface is connected directly to that part of the wall that forms the cam.

In the second alternative form, advantageously, in a way known per se, the operating member has a peg and the latch-release mechanism comprises an actuating lever which is equipped with a thrust surface for performing the movement of actuating the operating member in response to actuation of the door handle by the user, the said thrust surface being designed such that, when the operating member is in the active position, the thrust surface comes up against and pushes along the peg, during the actuating movement, in contact with the pawl in order to move it into the escapement position, and such that, when the operating member is in the inhibited position, the thrust surface no longer comes into contact with the peg, so that the operating member has no effect on the pawl.

According to another preferred embodiment of the invention, the opening catch-up means is produced as follows: the thrust surface of the lever and the adjacent part of the peripheral surface of the peg of the operating member are shaped and positioned in such a way that they respectively form a cam and a cam follower that interact with one another when the actuating lever is more or less in the end of actuating movement position, the movement of the said operating member by the electric device until it reaches its active position driving, thanks to the cam action of the thrust surface, the peg of the operating member until the said pawl has been placed in the "escapement" position.

Advantageously, the peg has a part that projects on each side of the mean plane of the operating member, it being possible for one of the two projecting portions to interact with the thrust surface of the lever, and it being possible for the other projecting portion to interact with a contact surface of the pawl in order to bring it into the "escapement" position.

Thus, thanks to the invention, the door can be opened by operating the door handle just once, and this can be achieved despite the difference there is between the response time of the release mechanism, which is very fast, and that of the electric unlocking device, which is slower.

It is advantageous to envisage that the unlock signal is transmitted by recognition electronics which are electrically powered only when the user exerts action on the door handle, the said electronics then identifying an authorized user by a radioelectric transmission exchanged in accordance with an appropriate protocol with an electronic element worn or carried by the user; this avoids needless consumption of electrical power. This can be obtained using a microswitch (or any other operating system) that is normally open, the closure of which is brought about by the opening action on the door handle, this operating system completing the recognition electronics power-supply circuit.

Other features and advantages of the invention will become clear from reading the description, given hereinbelow by way of non-limiting indication, of two preferred embodiments, the description being given with reference to the appended drawings.

DESCRIPTION OF THE FIGURES

FIGS. 5 to 8 correspond to FIGS. 1 to 4 respectively, but depict another embodiment of the invention;

FIG. 9A is a diagrammatic part view of a lock of the prior art, showing the movement of the operating member between the inhibited and active positions, with respect to the actuating lever at rest;

FIG. 9B shows the movement of the actuating lever of FIG. 9A when the operating member is in the active position; FIG. 9C shows the movement of the operating member from its inhibited position towards its active position when the actuating lever of FIG. 9A has already been moved into the actuated position;

DESCRIPTION OF THE PREFERRED EMBODIMENT

Figure 2:
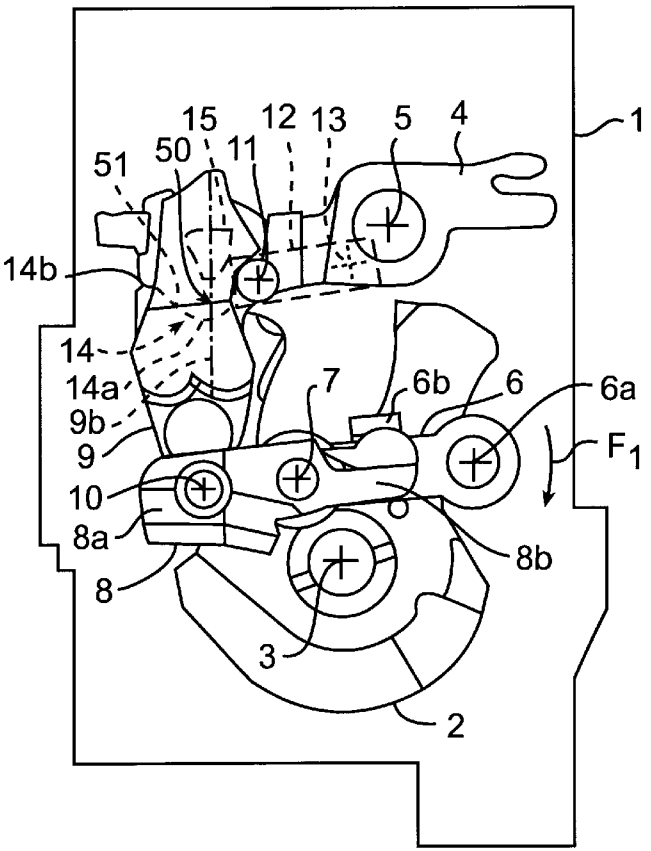
FIG. 2 PRIOR ART
FIG. 2 depicts a view similar to FIG. 1, showing the operating member in the inhibited position and the actuating lever at rest.
Figure 1:
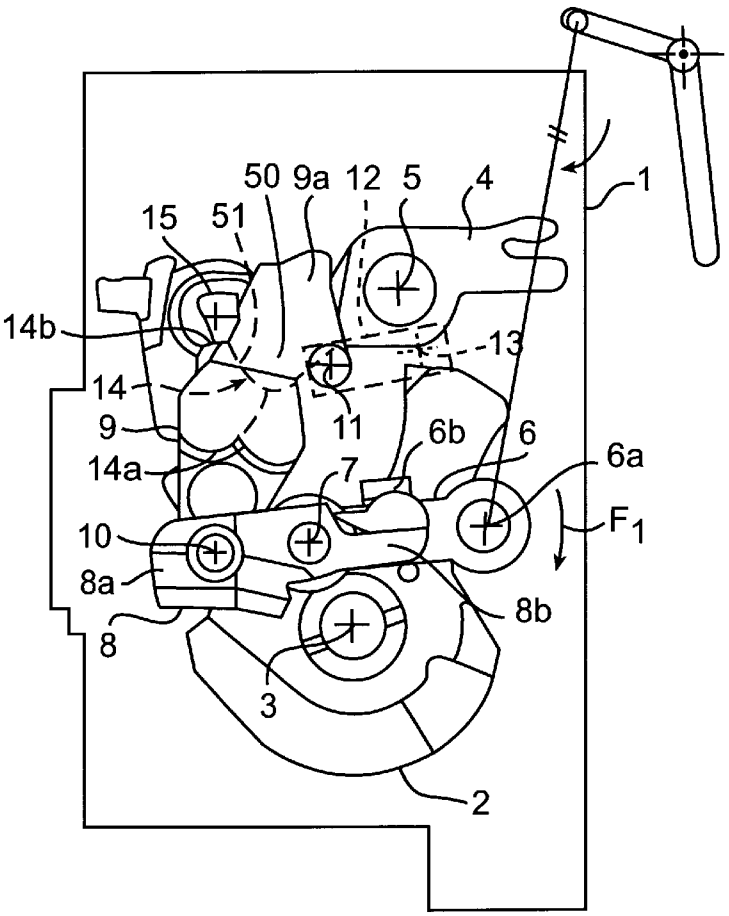
FIG. 1 PRIOR ART
FIG. 1 depicts a partial elevation of a lock according to one embodiment of the invention, the operating member being in the active position, the actuating lever connected to the door handle being in a position of rest.
Figure 3:
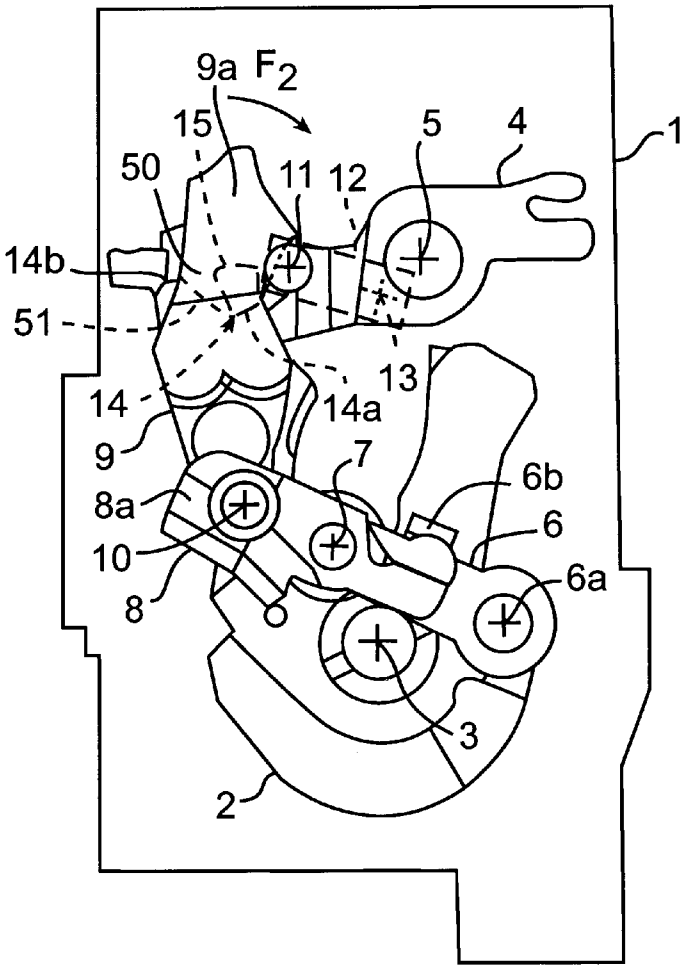
FIG. 3 depicts a view similar to FIG. 1, showing the operating member in the inhibited position and the actuating lever in the actuated position.

According to the first embodiment, the lock depicted in FIGS. 1 to 4 comprises a housing 1, a forked latch 2 articulated to the housing 1 at 3, and a pawl 4 articulated to the housing 1 at 5. The latch 2 is intended to interact, in the known way, with a striker, not depicted. The pawl 4, as is known, is associated with elastic means, not depicted, urging it towards a position that locks the latch 2 in the closed position, as depicted in FIGS. 1 to 3, and it can be placed in an "escapement" position, against the action of the said elastic means, by a latch-release mechanism controlled by a door handle (or hinged lever), not depicted.

The latch-release mechanism comprises, as is known, a lever 6 articulated to the housing 1 at 7, a second lever 8 articulated to the housing 1 on the same spindle 7 as the first lever 6, and a link 9, which in FIGS. 1 to 4 is approximately vertical, articulated by its lower end 10 to an arm 8*a* of the second lever 8. The link 9 constitutes the member for operating the pawl 4.

The lever 6 is mechanically connected by an articulation spindle 6*a* to the door handle and is associated with elastic means urging it towards its position of rest in which it has been depicted in FIGS. 1 and 2. It comprises a projection 6*b* forming a stop for the arm 8*b*, the opposite to the arm 8*a*, of the second lever 8. The latter lever is equipped with elastic means, not depicted, urging it in the direction that presses the arm 8*b* against the projection 6*b*.

Figure 4:
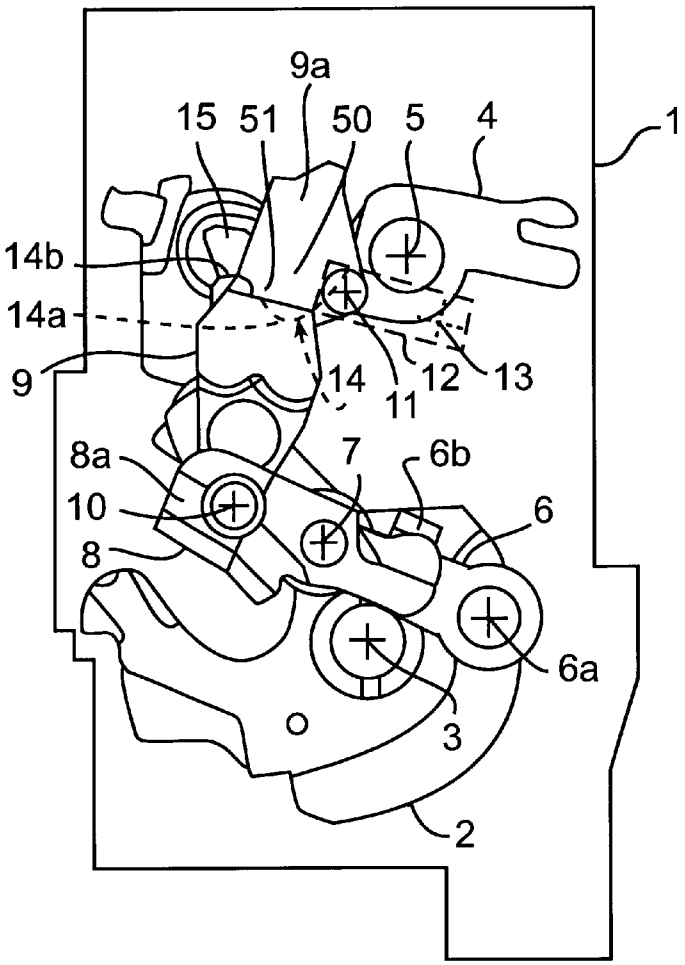
FIG. 4 depicts a view similar to FIG. 1, showing the operating member in the active position and the actuating lever in the actuated position.

At its opposite end to the articulation 10, the link 9 is articulated at 11 to a second link 12, depicted diagrammatically in a dashed line in the drawing, that forms part of an electric locking/unlocking device of a known type. The link 12 is connected at 13 to a moving part, not depicted, which can adopt two fixed positions with respect to the housing 1. One of these positions, and the corresponding position of the connection 13 depicted in FIGS. 1 and 4, are so-called unlocked positions and correspond to a so-called active angular position of the link 9; the other of these positions, and the corresponding position of the connection 13 depicted in FIGS. 2 and 3, are so-called locked positions and they correspond to a so-called inhibited angular position of the link 9. The moving part carrying the connection 13 is moved by an electric actuator, 149 shown only in FIGS. 1, 2, designed to respond to a lock signal and to an unlock signal by placing the said part, and therefore the connection 13, respectively, in their locked position (and consequently the link 9 in its inhibited position) and in their unlocked position (and consequently the link 9 in its active position).

The unlock signal may be transmitted by recognition electronics 150, forming part of a "hands-free access" system known per se requiring the use of neither key nor remote control in order to unlock the vehicle. In this system, the recognition electronics are equipped with a radio transmitter and are designed to be able to dialogue with a radioelectric device incorporated into a wristwatch or a card or a badge worn or carried by the user. The recognition electronics do not produce their unlock signal until the correct owner has been identified.

For each fixed position of the connection 13, the link 9 thus forms, with the link 12 and the lever 8, an articulated parallelogram. When the lever 6 is pivoted in the direction of arrow F1, by actuating the door handle, the link 9 experiences a so-called actuating movement upwards, during which the said link 9 may or may not act on the pawl 4 in order to bring it into the "escapement" position (the position depicted in FIG. 4), as will be explained later.

The link 9 has an upper end part 9*a* which is not as thick as the rest, this reduction in thickness producing a discontinuous surface 14 comprising a concave curved part 14*a* with the concave side facing upwards (see FIG. 1) and a flat part 14*b* connected directly to the said curved part 14*a* and terminating the said discontinuous surface 14 on the opposite side to the articulation 11. The concave part 14*a* of the discontinuous surface 14 delimits a recess 50 on the side of the face of the link 9 that faces towards the pawl 4.

On its face that faces towards the link 9, the pawl 4 has a peg 15 projecting towards the said link 9.

The elements 6 to 14 constituting the latchrelease mechanism and the peg 15 of the pawl 4 are together arranged in such a way that, when the link 9 is in the active angular position (FIGS. 1 and 4), it can, during its actuating movement, act on the pawl 4, by the action of the flat surface 14*b* on the peg 15, in order to bring the pawl 4 into the escapement position, and that when it is in the inhibited angular position (FIGS. 2 and 3), it has no effect on the pawl 4 during its actuating movement, the peg 15 then remaining, throughout the actuating movement of the link 9, engaged in the recess delimited towards the bottom by the concave part 14*a* of the discontinuous surface 14.

The fraction 51, situated to the left in the drawing, of the concave curved part 14*a* of the discontinuous surface 14 is inclined in the direction downwards and to the right in FIGS. 1 to 4, so as to form with respect to the axis 9*b* of the actuating movement (see FIG. 2) of the link 9 an angle that is preferably greater than 45 degrees. Thus, the part 51 forms a cam interacting with the peg 15 when (1) the link 9 is approximately at the end of its actuating movement and (2) it experiences, driven by the electric device, a movement of pivoting about the axis 10 in the direction of arrow F2 (FIG. 3). The cam-forming fraction 51 is dimensioned in such a way that, as it interacts with the peg 15, the latter is moved upwards until the pawl 4 reaches its "escapement" position. That part of the peripheral surface of the peg 15 that is adjacent to the cam 51 is rounded in order to facilitate the action of the cam 51 on the peg 15 that constitutes the cam follower.

The way in which the lock depicted in FIGS. 1 to 4 works is as follows.

FIG. 1 depicts the lock in a starting position in which the link 9 is in the active position (lock unlocked) and the lever 6 is in the position of rest. If, under these conditions, action is exerted on the door handle, the lever 6 and therefore the lever 8 are tilted in the direction of arrow F1, causing an upwards movement of the articulation spindle 10 and therefore of the link 9 which, finding itself in the active position, will, via its thrust surface 14*b*, act as it moves on the peg 15 in order to pivot the pawl 4 until it reaches its "escapement" position (see FIG. 4).

FIG. 2 depicts the lock in a starting position in which the link 9 is in the inhibited position (lock locked) and the lever 6 is in the position of rest. If, under these conditions, action is exerted on the door handle and, at the same time, the electric device is activated by emitting an unlock signal produced, for example, by bringing a badge closer to the lock, this will initially result in the situation depicted in FIG. 3: the action on the door handle will, as in the previous instance, cause an upwards movement of the link 9, but the tilting of the link 9 from its inhibited starting position into its active position will not take place until later because the electric device is slower than the release mechanism. Thus, until the end of the actuating movement of the link 9, the latter will remain in its inhibited position, which means that the peg 15 will remain engaged in the recess 50 delimited by the concave part 14*a* of the discontinuous surface 14.

When the electric device begins to act, by pulling to the right in the drawing the articulation spindle 11 connecting the link 9 to the second link 12, thanks to the inclined-cam shape of the part 51 of the discontinuous surface 14 and to the rounded shape of the adjacent surface of the peg 15, the peg 15 will not jam in the recess 50 of the link 9 but, to the contrary, the cam effect will cause the lifting of the peg 15 and consequently the pivoting of the pawl 4 in the clockwise direction until the said pawl has been brought into its "escapement" position, as depicted in FIG. 4, in which it no longer acts on the forked latch 2, thus allowing the door to be opened.

Figure 7:
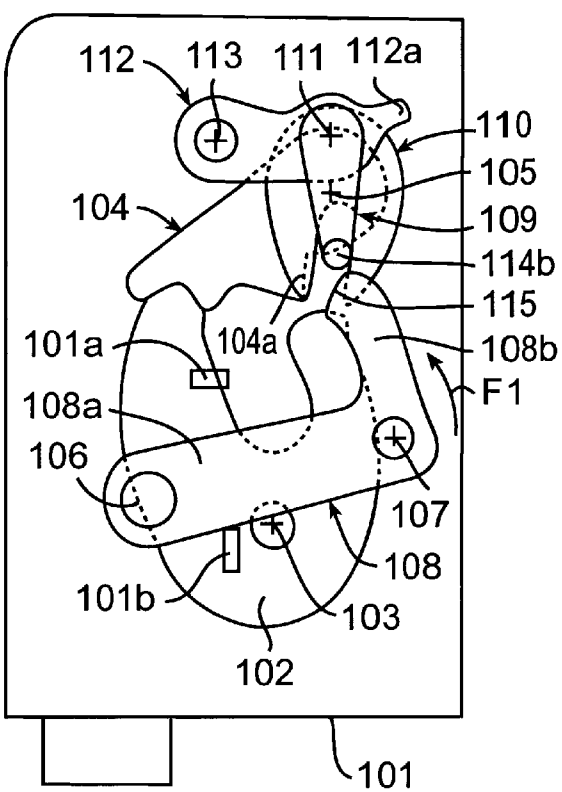
Figure 6:
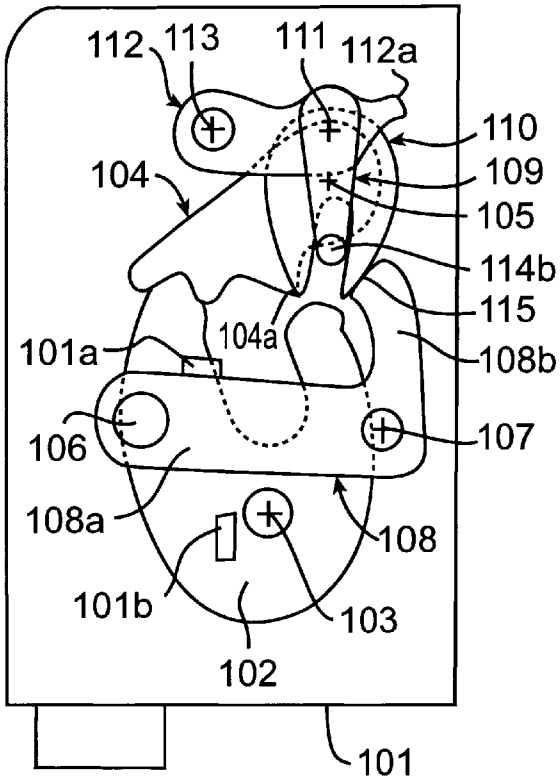
Figure 5:
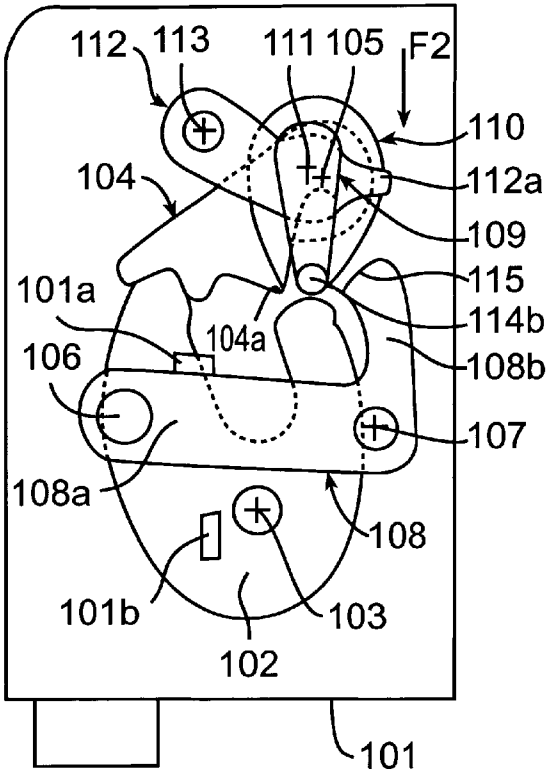

According to the second embodiment, the elements of the lock depicted in FIGS. 5 to 8 which are identical or similar to those of the first embodiment carry, as a general rule, the same reference numerals, increased by 100. The lock of the second embodiment comprises, in the way known per se, a housing 101, a forked latch 102 articulated to the housing 101 at 103, and a pawl 104 articulated to the housing 101 at 105. The latch 102 is intended to interact, in the known way, with a striker, not depicted. The pawl 104, in the known way, is associated with elastic means, not depicted, urging it into a position that locks the latch 102 in the closed position, as depicted in FIGS. 5 to 7, and it can be brought into the "escapement" position against the action of the said elastic means, by a latch-release mechanism operated by a door handle "or hinged lever", not depicted.

The latch-release mechanism comprises, as is known, an actuating lever 108 articulated to the housing 101 on a spindle 107, and a link 109 which is approximately vertical in FIGS. 5 to 8, articulated by its upper end 111 to an operating lever 112 that forms part of an electric locking/unlocking device of a known type.

The actuating lever 108 is mechanically connected by an articulation spindle 106 to the door handle, generally via an opening linkage or cable, and the actuating lever 108 is associated with elastic means (not depicted) urging it into its position of rest in which it has been depicted in FIGS. 5 and 6. One arm 108*a* of the actuating lever 108 is intended to press against a projection 101*a* of the housing 101, under the action of the aforementioned elastic means which urge the arm 108*a* against the projection 101*a*. There is another projection 101*b* provided on the housing 101 to limit the tilting of the arm 108*a* during its actuating travel. The entry to the throat of the lock has been indicated in 101*c* in FIG. 8.

The operating lever 112 is articulated at 113 to the housing 101 and comprises a projecting portion 112*a* which is intended to be actuated by a moving part, not depicted, for example a fork-shaped part, of the electric locking/unlocking device, it being possible for the said operating lever 112 to adopt two fixed positions with respect to the housing 101. A so-called unlocked position of the operating lever 112 is illustrated in FIGS. 5 to 8 and corresponds to a so-called active position of the link 109 in the vertical direction (the link 109 constitutes the member for operating the pawl 104); the other, so-called locked, position of the operating lever 112 is depicted in FIGS. 6 and 7 and corresponds to a so-called inhibited position of the link 109 in the vertical direction. The moving part acting on the portion 112*a* of the operating lever 112 is moved by an electric actuator, not depicted, designed to respond to a lock signal and an unlock signal by placing the said part and therefore the portion 112*a*, respectively, in their locked position (and consequently the link 109 in the inhibited position), and in their unlocked position (and consequently the link 109 in the active position).

A guide piece 110 is articulated to the same spindle 105 as the pawl 104 and is in the shape of a fork, between the arms of which is housed a portion 114*a* of a peg 114 which is provided on the lower end of the link 109. The peg 114 projects at right angles from each side of the mid plane of the link 109, the projecting portion 114*a* of the peg 114 being situated on that face of the link 109 which faces towards the pawl 104, and the opposite projecting portion 114*b* of the peg 114 being situated on that face of the link 109 which faces towards the actuating lever 108. The fork housing of the guide piece 110 serves to guide the portion 114*a* of the peg 114 in an approximately vertical direction when the link 109 is moved between its active and inhibited positions by the operating lever 112. The projecting portion 114*a* of the peg 114 is positioned and shaped in such a way that it can come into contact with a contact surface 104*a* of the pawl 104 in order to move it into its escapement position (the position depicted in FIG. 8), as will be explained later.

The guide piece 110 has, as is known, a certain relative mobility in terms of rotation with respect to the pawl 104, so that the movement of opening from the inside is decoupled from the movement of opening from the outside, in order to avoid the exterior handle moving when the interior handle is actuated.

Figure 11:
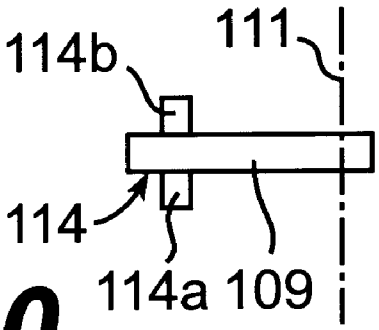
FIG. 11 is a side elevation of the operating member of the embodiment of FIGS. 5 to 8.

The arm 108*b*, which is the opposite to the arm 108*a*, of the actuating lever 108, has at its free end an approximately flat thrust surface 115 facing towards part of the peripheral surface of the projecting portion 114*b* of the peg 114. Although in FIG. 11 the portions 114*a* and 114*b* are aligned, it is possible to envisage a peg 114 having portions 114*a* and 114*b* which are offset with respect to one another.

The elements 106 to 115 that constitute the latch-release mechanism, and the contact surface 104*a* of the pawl 104 are arranged together in such a way that when the link 109 is in the active position (FIGS. 5 and 8) it can, during its actuating movement, act on the pawl 104, by the action of the projecting portion 114*a* of the peg 114 on the contact surface 104*a* of the pawl 104, in order to bring the pawl 104 into the escapement position, and so that when it is in the inhibited position (FIGS. 6 and 7), during its actuating movement it has no effect on the pawl 104, the peg 114 then remaining, throughout the actuating movement by the actuating lever 108, retracted upwards with respect to the thrust surface 115 of the actuating lever 108.

Figure 10:
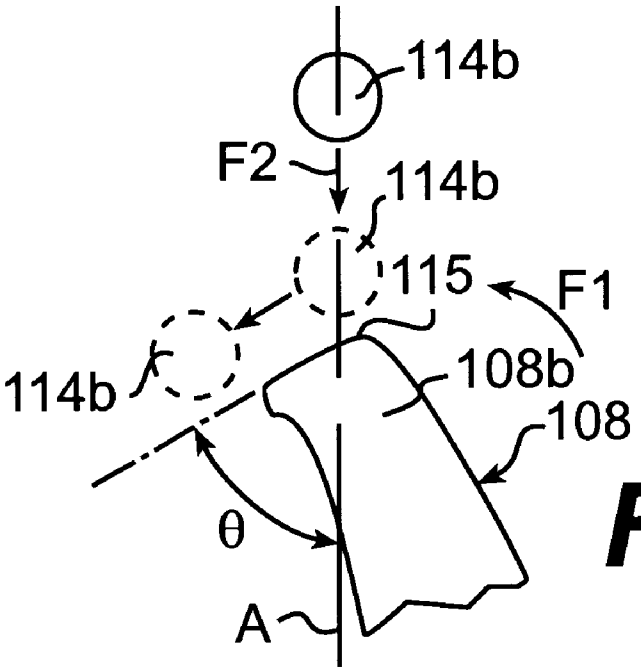
FIG. 10 is a view similar to FIG. 9C, but depicts the lock according to the embodiment of FIGS. 5 to 8.

The thrust surface 115 of the arm 108*b* of the actuating lever 108, is inclined downwards and to the left in FIGS. 5 to 8, so as to form, with respect to the axis A of the locking/unlocking movement of the link 109, an angle θ that is preferably between 30° and 60°, when the lever 108 is at the end of its actuating movement travel in the direction of arrow F1 (see FIG. 10). Thus, the thrust surface 115 forms a cam interacting with the projecting portion 114*b* of the peg 114 when the actuating lever 108 is approximately at the end of the actuating movement in the direction of arrow F1 and the link 109 experiences, driven by the electric device, an approximately vertical translational movement in the direction of arrow F2. The thrust surface 115 is dimensioned in such a way that as it interacts with the portion 114*b* of the peg 114, the latter is moved downwards and to the left in FIG. 10, until the portion 114*a* of the peg 114 comes into contact with the contact surface 104*a* of the pawl 104 in order to bring it into its escapement position. That part of the peripheral surface of the peg 114 that is adjacent to the cam 115 is rounded to facilitate the action of the cam 115 on the portion 114*b* of the peg 114 that constitutes the cam follower.

Referring now to FIGS. 9A to 9C, the operation of a lock in accordance with the prior art will be described. FIG. 9A depicts the movement of the peg 114 of the operating member between its inhibited position and its active position, when the actuating lever 108 is at rest. In this position, the peg 114 reaches its position illustrated in broken line which is facing a thrust surface 115' of the arm 108*b* of the actuating lever 108. Then, under the action of the pivoting of the actuating lever 108, in the direction of arrow F1, the peg 114*b* of the operating member experiences a rotation about its fixed spindle ill, under the action of the thrusting of the thrust surface 115' against the portion 114*b* of the peg 114, to bring it into contact with the pawl 104 and push it into the escapement position. It can be seen from FIG. 9B that the thrust surface 115' is approximately parallel to the direction of travel F2 of the operating member between its inhibited and active positions. In FIG. 9C, the actuating lever 108 is already tilted to the end of its actuating travel, while the peg 114*b* of the operating member is still in its inhibited position. As the peg 114*b* moves towards its active position, the peg 114*b* comes up against a wall portion 115'*a* of the actuating lever 108, the said wall portion 115'*a* being approximately at right angles to the direction F2, which means that the peg 114*b* is blocked by the arm 108*b* of the actuating lever 108 and cannot, as illustrated in broken line, reach the position that allows the pawl to be placed in the escapement position, because the portion 114*b* of the peg 114 cannot come into contact with the thrust surface 115' of the actuating lever 108.

The way in which the lock depicted in FIGS. 5 to 8 works is as follows.

FIG. 5 depicts the lock in a starting position in which the link 109 is in the active position (lock unlocked) and the actuating lever 108 is in the position of rest. If, under these conditions, action is exerted on the door handle, the lever 108 is tilted in the direction of arrow F1 (see FIG. 8), the thrust surface 115 coming into contact with the portion 114*b* of the peg 114 of the link 109 and causing it to pivot about the fixed point 111, until the portion 114*a* of the peg 114 comes into contact with the contact surface 104*a* of the pawl 104 to make it pivot into its escapement position.

FIG. 6 depicts the lock in a starting position in which the link 109 is in the inhibited position (lock locked) and the lever 108 is in the position of rest. If, under these conditions, action is exerted on the door handle and, at the same time, the electric device is activated by emitting an unlock signal produced, for example, by bringing a badge closer to the lock, this will first of all result in the situation depicted in FIG. 7: the action on the door handle will, like in the previous instance, cause the thrust surface 115 to tilt in the direction of arrow F1, but the movement of the link 109 from its inhibited starting position into its active position will not occur until later because the electric device is slower than the release mechanism. Thus, until the end of the actuating movement by the actuating lever 108, the link 109 will remain in the inhibited position, which means that the peg 114 will remain retracted with respect to the thrust surface 115.

When the electric device begins to act, tilting downwards the articulation spindle 111 connecting the link 109 to the operating lever 112, thanks to the inclined-cam shape of the thrust surface 115 of the actuating lever 108 and to the rounded shape of the adjacent surface of the projecting portion 114*b* of the peg 114, the projecting portion 114*b* of the peg 114 will not be blocked against the arm 108*b* of the actuating lever 108 but, to the contrary, the cam effect will cause the portion 114*b* of the peg 114 to slide over the inclined thrust surface 115 and consequently cause the link 109 to pivot, in the clockwise direction, about the fixed spindle 111, until the portion 114*a* of the peg 114 is brought up against the contact surface 104*a* of the pawl 104 which will pivot into its escapement position as depicted in FIG. 8, in which position the pawl 104 no longer acts on the forked latch 102, thus allowing the door to be opened.

Thus, thanks to the invention, the door handle need be actuated just once in order to open this door, and this is true despite the difference in response times that there is between the response time of the release mechanism, which is very fast, and that of the electric locking/unlocking device, which is slower.

It is advantageous to envisage that the recognition electronics are not electrically powered until the user exerts an action on the handle in order to open the door, this being in order to avoid needless consumption of electrical power. This can be obtained using a micro-switch (or any other operating system), not depicted, which is normally open, and the closure of which is brought about by action on the door handle, this micro-switch completing a recognition-electronics power-supply circuit, not depicted.

What is claimed is:

1. Door lock for a vehicle comprising:

a forked latch which interacts with a striker;

a pawl positionable to lock the forked latch in a closed position and positionable to an escapement position in which said pawl no longer locks said forked latch;

a latch-release mechanism comprising an operating member for moving the pawl to said escapement position, said operating member being coupled to the pawl and through a mechanical coupling to an outside door handle of the vehicle so that said operating member is actuatable by said outside door handle through said mechanical coupling upon actuation of the outside door handle by a user of the vehicle;

an electric locking/unlocking device which is mechanically coupled to the operating member and in response to an unlock signal moves said operating member from a first position, in which the operating member is unable to move the pawl to the escapement position when the operating member is actuated by said mechanical coupling, upon actuation of the outside door handle, to a second position in which the operating member is able to move the pawl to the escapement position when the operating member is actuated by said mechanical coupling upon actuation of the outside door handle, and said electric locking/unlocking device moving said operating member from said second position to said first position in response to a lock signal; and camming means on said operating member for displacing said pawl to said escapement position by a movement of said operating member form said first position to said second position under action of said electric locking/unlocking device when said unlock signal is transmitted at substantially the end of the actuation of the outside door handle by the user of the vehicle.

2. Lock according to claim 1, wherein the actuating movement of the operating member in response to actuation of the outside door handle by the user occurs both when said operating member is in the first position and when in the second position.

3. Lock according to claim 1, wherein the actuating movement of the operating member in response to actuation of the outside door handle by the user occurs when the operating member is in the second position.

4. Lock according to claim 2, wherein the pawl has a peg, and the operating member has a thrust surface and a recess which are designed such that, when the operating member is in the second position, the thrust surface pushes said peg during the actuating movement of the operating member until said pawl has been placed in the escapement position, and when the operating member is in the first position, the peg of the pawl, throughout the actuating movement of said operating member, remains engaged in said recess so that the operating member has no effect on the pawl.

5. Lock according to claim 4, wherein said camming means comprises a part of a wall delimiting said recess of the operating member and an adjacent part of a peripheral surface of the peg of the pawl, said part of the wall and said adjacent part of the peripheral surface of the peg being shaped and positioned in such a way that they respectively form a cam and a cam follower which interact with one another when the operating member in moved from said first position to said second position by the electric locking/unlocking device at the end of the actuating movement of the operating member in response to the actuation of the outside door handle by the user, whereby the pawl is displaced to the escapement position by a cam action of said part of said wall on the peg of the pawl.

6. Lock according to claim 5, wherein the thrust surface is connected directly to the part of the wall that forms the cam.

7. Lock according to claim 3, wherein the operating member has a peg engaging said pawl, and the latch-release mechanism further comprises an actuating lever which is mechanically coupled to the outside door handle and is equipped with a thrust surface for actuating the operating member in response to actuation of the outside door handle by the user, said thrust surface engaging and pushing the peg when the operating member is in the second position and the actuating lever is moved in response to the actuation of the outside door handle, whereby said pawl is moved into the escapement position, and said peg being out of a path of travel of the thrust surface of the actuating lever when the operating member is in the first position and the actuating lever is moved in response to the actuation of the outside door handle, whereby the thrust surface no longer comes into contact with the peg and the operating member has no effect on the pawl wherein the actuating lever is moved in response to the actuation of the outside door handle.

8. Lock according to claim 7, wherein said camming means comprises the thrust surface of the actuating lever and an adjacent part of the peripheral surface or the peg of the operating member, said thrust surface and said adjacent part forming respectively a cam and a cam follower that interact with one another when the operating member is moved from said first position to said second position by the electric locking/unlocking device while said thrust surface is at the end of said path of travel, whereby said pawl is displaced to the escapement position by the peg of the operation member by virtue of a cam action of said thrust surface on the peg of the operating member.

9. Lock according to claim 7, wherein the peg has two projecting portions which project respectively on each side of a mean plane of the operating member, one of the two projection portions interacting with the thrust surface of the actuating lever, and an other of the two projecting portions interacting with a contact surface of the pawl in order to bring said pawl into the escapement position.

10. Lock according to claim 1, wherein the unlock signal is transmitted by recognition electronics which are electrically powered only when the user exerts action on the outside door handle, said recognition electronics identifying an authorized user by a radioelectric transmission exchanged with an electronic element possessed by the user.

11. Lock according to claim 10, wherein the recognition electronics are powered through a switch which is normally open, closure of which is brought about by an opening action on the outside door handle, said switch, when closed, completing a recognition-electronics power-supply circuit.

12. Lock according to claim 8, wherein the peg has two projecting portions which project respectively on each side of a mean plane of the operating member, one of the two projecting portions interacting with the thrust surface of the actuating lever, an other of the two projecting portions interacting with a contact surface of the pawl in order to bring said pawl into the escapement position.

13. Lock according to claim 2, wherein the unlock signal is transmitted by recognition electronics which are electrically powered only when the user exerts action on the outside door handle, the recognition electronics identifying an authorized user by a radioelectric transmission exchanged with an electronic element possessed by the user.

14. Lock according to claim 3, wherein the unlock signal is transmitted by recognition electronics which are electrically powered only when the user exerts action on the outside door handle, the recognition electronics identifying an authorized user by a radioelectric transmission exchanged with an electronic element possessed by user.

15. Lock according to claim 4, wherein the unlock signal is transmitted by recognition electronic which are electronically powered only when the user exerts action on the outside door handle, said recognition electronics identifying an authorized user by a radioelectric transmission exchanged with an electronic element possessed by the user.

16. Lock according to claim 5, wherein the unlock signal is transmitted by recognition electronics which are electrically powered only when the user exerts action on the outside door handle, said recognition electronics identifying an authorized user by a radioelectric transmission exchanged with an electronic element possessed by the user.

17. Lock according to claim 6, wherein the unlock signal is transmitted by recognition electronics which are electrically powered only when the user exerts action on the outside door handle, said recognition electronics identifying an authorized user by a radioelectric transmission exchanged with an electronic element possessed by the user.

18. Lock according to claim 7, wherein the unlock signal is transmitted by recognition electronic which are electrically powered only when the user exerts action on the outside door handle, said recognition electronics identifying an authorized user by a radioelectric transmission exchanged with an electronic element possessed by the user.

19. Lock according to claim 8, wherein the unlock signal is transmitted by recognition electronics which are electrically powered only when the user exerts action on the outside door handle, the recognition electronics identifying an authorized user by a radioelectric transmission exchanged with an electronic element possessed by the user.

20. Lock according to claim 9, wherein the unlock signal is transmitted by recognition electronics which are electrically powered only when the user exerts action on the outside door handle, the recognition electronics identifying an authorized user by a radioelectric transmission exchanged with an electronic element possessed by the user.

* * * * *

UNITED STATES PATENT AND TRADEMARK OFFICE

CERTIFICATE OF CORRECTION

PATENT NO. : 6,286,878 B1
DATED : September 11, 2001
INVENTOR(S) : Jean-Philippe Hochart et al.

It is certified that error appears in the above-identified patent and that said Letters Patent is hereby corrected as shown below:

Drawings,

The figures 1 and 2 have been labeled as "prior art", they should not be labeled as prior art. Please delete "prior art for figures 1 and 2.

Signed and Sealed this

Seventh Day of May, 2002

*Attest:*

*Attesting Officer*

JAMES E. ROGAN
*Director of the United States Patent and Trademark Office*